United States Patent [19]

Kozuka et al.

[11] 4,260,238

[45] Apr. 7, 1981

[54] TRANSFER TYPE ELECTROSTATIC COPYING APPARATUS

[75] Inventors: Nobuhiko Kozuka, Suita; Toru Nakazawa, Osaka, both of Japan

[73] Assignee: Mita Industrial Co., Ltd., Osaka, Japan

[21] Appl. No.: 49,640

[22] Filed: Jun. 18, 1979

[30] Foreign Application Priority Data

Jun. 24, 1978 [JP] Japan ..... 53-76659

[51] Int. Cl.[3] ..... G03G 15/00

[52] U.S. Cl. ..... 355/3 TR; 355/3 R

[58] Field of Search ..... 355/3 R, 3 TR, 14 TR

[56] References Cited

U.S. PATENT DOCUMENTS

| | | | |
|---|---|---|---|
| 3,884,572 | 5/1975 | Bacon et al. | 355/15 |
| 4,170,413 | 10/1979 | Bayer | 355/3 R |
| 4,173,406 | 11/1979 | Oyama et al. | 355/3 R |

*Primary Examiner*—Fred L. Braun

*Attorney, Agent, or Firm*—Wenderoth, Lind & Ponack

[57] ABSTRACT

A transfer type electrostatic copying apparatus employs a photosensitive member of organic photoconductive material and one-component developing toner. There is provided a charge eraser lamp for erasing or removing a residual charge remaining on the surface of the photosensitive member after the transfer process. The charge eraser lamp has spectral characteristic so as to not emit ultraviolet rays and near ultraviolet rays, whereby any reduction of density is avoided and improved quality of the copied image is achieved.

4 Claims, 1 Drawing Figure

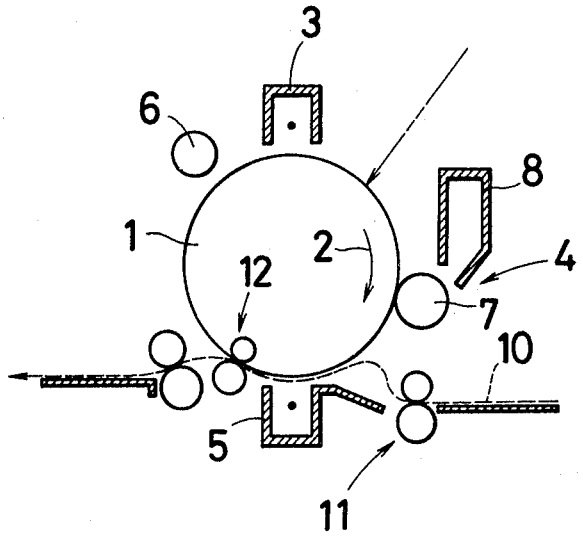
3
6
8
1
2
4
12
7
10
5
11

TRANSFER TYPE ELECTROSTATIC COPYING APPARATUS

BACKGROUND OF THE INVENTION

1. Field of the Invention

The present invention relates to an electrostatic copying apparatus in which an electrostatic image formed on the surface of a photosensitive member and corresponding to an original document is developed by a developing material into a visible toner image for subsequent transfer thereof onto a transfer paper or copying paper, and more particularly to a transfer type electrostatic photographic copying apparatus equipped with a charge eraser lamp disposed posterior to the transfer process for removal of residual charge remaining on the photosensitive member.

2. Description of the Prior Art

In the conventional transfer type electrostatic copying apparatus, organic photoconductive material is used as the photosensitive medium or photoreceptor on which the electrostatic latent image is to be formed, and for developing such electrostatic latent image formed on the photosensitive member, two component developing material which is a mixture of carrier and toner with a high electrical insulation has been employed. The organic photoconductive material which is inexpensive, highly sensitive, easy to manufacture and further flexible has such advantages that it can be formed not only into a drum shape, but also into a belt-like configuration for use, and therefore, it has come to be widely employed as a photosensitive member for electrophotography in spite of its physical and chemical unstability as compared with inorganic photoconductive materials.

Accordingly, when the two-component developing material is to be employed, it is necessary to maintain the mixing ratio of the carrier and toner constant at all times, while due to the limited life of the carrier, it is also required to periodically exchange the developing material in the developing device, and thus, the two-component developing material cannot be said to be easy to maintain, with a further problem that the size of the developing device is comparatively increased. Different from the two-component developing material as described above, one-component developing material containing no carrier is superior in that it is free from the above-mentioned problems and has the possibility of wide application in the future.

Accordingly to experiments carried out by the present inventors, it is found that, in a transfer type electrostatic copying apparatus which employs a photosensitive member made of the organic photoconductive material and the one-component developing material, a new phenomenon takes place in which the density of the copied images is reduced upon repetition many times of the copying operation. The reduction of the image density as described above is a phenomenon previously unnoticed and is different from the conventionally-known fatigue phenomenon of the photosensitive member, and thus, it is made clear that, unless such a new phenomenon is eliminated, the transfer type electrostatic copying apparatus utilizing a photosensitive member of organic photoconductive material and one-component developing material will be difficult to be brought into actual use.

In brief, therefore, a prior art transfer type electrostatic copying apparatus employing a photosensitive member made of organic photoconductive material and the one-component developing material has suffered from reduction of density and lower quality of the copied image.

SUMMARY OF THE INVENTION

By means of the concept of the invention, the above-mentioned shortcomings of the prior art are avoided, and prevention of reduction of density and improved quality of the copied image are achieved in a transfer type electrostatic copying apparatus employing a photosensitive member of organic photoconductive material and one-component developing material. Objectives of the invention include providing a transfer type photoelectrostatic copying apparatus wherein a charge eraser lamp for erasing or removing residual charge on the surface of the photosensitive member after the developing and transfer processes has spectral characteristic so as to not emit ultraviolet rays and near ultraviolet rays. By the employment of the charge erasing lamp so specially devised, copied images having improved quality free from reduction of image density after many copying operations may advantageously be obtained.

In accordance with a preferred embodiment of the invention, the charge eraser lamp is a lamp which does not emit ultraviolet rays and near ultraviolet rays. Alternatively to this lamp, in another preferred embodiment, the charge eraser lamp means has a lamp which emits rays including ultraviolet rays and/or near ultraviolet rays, and an optical filter provided between the lamp and the photosensitive member. The optical filter absorbs ultraviolet rays and near ultraviolet rays.

Accordingly, it is a primary object of the invention to provide an improved transfer type electrostatic copying apparatus which employs a photosensitive member of organic photoconductive material and one-component developing material.

It is another object of the present invention to provide an improved transfer type electrostatic copying apparatus of the above described type which is arranged to prevent reduction of image density.

BRIEF DESCRIPTION OF THE DRAWING

These and other objects of the invention will become apparent from the following description, taken together with the accompanying drawing, in which:

The single FIGURE is a schematic cross sectional view of an electrostatic copying apparatus according to the invention.

DETAILED DESCRIPTION OF THE PREFERRED EMBODIMENT

The present inventors made a detailed investigation as follows into the phenomenon related to the reduction of copied image density in a transfer type electrostatic copying apparatus which employs a photosensitive member made of organic photoconductive material and one-component developing material. As a result, it has been found that, upon measurements taken by an electric field measuring apparatus, the amounts of charge of the electrostatic latent images to be formed on photosensitive members are equal both in a fresh photosensitive member that can provide copied images of proper density and in a used photosensitive member that provides copied images of reduced density, and nevertheless, the amount of the adhering developing material is small in the used photosensitive member, with the developing efficiency of such used photosensitive member being remarkably reduced to a large extent. The phenomenon as described above specifically takes place when electrically conductive or semi-electrically conductive toner that is capable of being polarized under the electric field as the one-component developing material is employed, while the reduction of the developing efficiency does not occur when the two-component developing material is used. In the above new phenomenon, restoration or recovery is not possible, and in this respect, the phenomenon differs from that in which the fatigue of a photosensitive member is recovered by allowing the photosensitive member to stand in a dark place for a predetermined period of time as is well-known to those skilled in the art.

The inventors have surmised the causes for the reduction of the developing efficiency and consequent reduction of the image density as follows.

The above causes may be classified into the following two items. (1) the surface of the photosensitive member made of organic photoconductive material is subjected to some chemical change after many copying operations. (2) Strict conditions are required for one-component developing on the organic photoconductive photosensitive member (i.e. adhesion of a large amount of developing material only by the small amount of electrical charge on the photosensitive member), and thus, the developing efficiency is adversely affected sensitively by the chemical change on the surface of the organic photoconductive photosensitive member.

With respect to the cause (1) mentioned above, according to the present invention, the chemical change of the organic photoconductive photosensitive member can be suppressed as far as possible by eliminating the generation of ultraviolet rays and near ultraviolet rays (which have wave lengths less than 3500 Å) from the charge eraser lamp. The charge eraser lamp is employed to remove a residual electrical charge remaining on the photosensitive member after transfer when the electrostatic latent image formed on the photosensitive member is developed so as to be transferred onto transfer material such as copy paper and the like, with subsequent removal of the developing material which remains on the photosensitive member after transfer in the transfer type electrostatic copying apparatus. By first dissipating the residual charge on the photosensitive member and then removing the developing material remaining on the photosensitive member, the surface of the photosensitive member can be more sufficiently cleaned. Since the conventional charge erasing lamps are of high output fluorescent lamps, the photosensitive surface exposed to the ultraviolet rays and near ultraviolet rays radiated from such lamps is readily subjected to chemical reaction with oxygen contained in air and ozone produced by the transfer corona charger so as to form oxides. In other words, the ultraviolet rays and near ultraviolet rays from the known charge eraser lamps act as activating energy expediting the oxidizing reaction of the photosensitive member surface. From the above point of view, the charge eraser lamp according to the present invention is arranged to have such spectral characteristics as to not radiate ultraviolet rays and near ultraviolet rays.

In connection with the cause (2) referred to above, the one-component developing material is the electrically conductive or electrically semi-conductive toner that may be polarized by electric field disclosed, for example, in U.S. Pat. No. 3,639,245, while the developing process of the electrostatic latent image thereof is disclosed, for example, in Japanese Patent Application No. 48-29898 (Tokukaisho No. 49-4532), etc. According to the above disclosures, there is stated in detail that such toner is subjected to polarization by induction or injection of a charge having a polarity opposite to the polarity of the electrostatic latent image in the toner, upon approaching or contact thereof with the electrostatic latent image on the photosensitive member so as to adhere to the latent image by the electric force thereof for effecting developing. It has been found, however, that the developing as described above is to be effected by the electrical charge produced in the toner through induction or polarization, and its developing efficiency is extremely small as compared with that in the conventional two-component developing material, while being largely affected also by the surface condition of the photosensitive member. More specifically, during development, since the toner is rubbed against the photosensitive member at a high speed, a triboelectric charge is built up respectively on the toner and photosensitive member through friction therebetween, and depending on the variation of the frictional charge sequence in the former and latter, force is exerted in a direction to retard or reduce the adhesion of the toner onto the photosensitive member. Furthermore, since the one-component toner as described above is low in electrical resistance, with small capacity to retain the charge which is produced by induction or polarization, the electrical charge tends to readily leak toward the surface of the photosensitive member depending on the physical properties of such surface, thereby resulting in marked reduction in the developing efficiency. As described in the foregoing, in a developing method utilizing a one-component developing material, it has been found that matching between the toner and the photosensitive member surface in physical properties is of extremely delicate nature, and the developing efficiency is particularly largely affected by the physical change with time of the photosensitive member. Accordingly, the prevention of the chemical change on the surface of the photosensitive member composed of organic photoconductive material as far as possible results in the prevention of reduction of the developing efficiency and consequently the deterioration of the image density by maintaining the optimum conditions under which the one-component developing material is applicable to developing.

Referring now to the drawing, one preferred embodiment according to the invention will be described hereinbelow. In this FIGURE, there is a schematic cross sectional view at an approximately central portion of a transfer type electrostatic copying apparatus according to the invention. The transfer type electrostatic copying apparatus of the FIGURE includes a drum 1 of cylindrical configuration having a photosensitive member which is composed of organic photoconductive material provided on its entire peripheral surface or at part of the peripheral surface in the circumferential direction thereof. By charging the photosensitive member surface by a corona charger 3, with subsequent slit exposure thereof to the light-wise image of an original document, and electrostatic latent image corresponding to the original document is formed on the photosensitive member, and further, by causing polarizable electrically conductive or semi-conductive toner to adhere to the electrostatic latent image by a developing and cleaning device 4, a toner image corresponding to the image of the original document is formed on the photosensitive member surface, and the toner image thus formed is subsequently transferred onto the transfer paper.

The above described copying apparatus according to the invention is of a type in which one copying operation is achieved through two revolutions of the photosensitive drum 1, and around drum 1 along the rotating direction 2 thereof, there are sequentially disposed the corona charger 3 for charging the photosensitive member, the developing and cleaning device 4 for developing the electrostatic latent image formed on the photoreceptor into a visible toner image and also for removing the toner remaining on the photosensitive member surface after the transfer for cleaning purposes, a transfer corona charger 5 for transferring the toner image formed on the photosensitive member onto the transfer paper, and the charge eraser lamp 6 for removing the electrical charge remaining on the photosensitive member after the transfer process. For the charge erasing lamp of the invention, any type of light source which has spectral characteristics as to not emit ultraviolet rays and near ultraviolet rays may be employed, and for example, the known incandescent lamps, halogen lamps, fluorescent lamps, etc. may be advantageously utilized. Meanwhile, for the photosensitive medium on the peripheral surface of the drum 1, a photosensitive member prepared by applying a photosensitive layer which is mainly composed of organic photoconductive material, etc. represented, for example, by polyvinylcarbazole and the like, onto an electrically conductive base made of metallic material, paper or plastic film, etc. treated for electrical conduction may be employed. The developing and cleaning device 4 is provided with a fundamentally known cylindrical sleeve 7 having a magnet member accommodated therein and a toner dispenser 8 for supplying toner onto sleeve 7.

Above the drum 1, there is disposed an optical system (not shown) for projecting the lightwise image of the original document onto the photosensitive member on the drum 1. As indicated by an imaginary arrow line in the drawing, the lightwise image of the original document is projected onto the photosensitive drum 1 at a position immediately downstream of the corona charger 3 for charging along the direction of rotation of the drum 1.

At the upstream side with respect to the transfer corona charger 5 along a transfer paper transporting path 10, a pair of feeding rollers 11 are provided, while at the downstream side of corona charger 5, another pair of separating rollers 12 are disposed. The pair of feeding rollers 11 are intended to supply transfer paper into the transfer zone at which transfer corona charger 5 is located. On the other hand, the pair of separating rollers 12 are arranged to separate the transfer paper closely adhering to the surface of the drum 1 at the transfer zone from drum 1 for directing the transfer paper out of the transfer zone.

The operation of the copying apparatus will be described hereinbelow. During copying, the drum 1 is driven for rotation in a direction indicated by the arrow 2, and the photosensitive member is charged by the corona charge of the corona charger 3 for charging. Subsequently, the photosensitive member of the drum 1 is subjected to the projection of the lightwise image corresponding to the original document as indicated by the imaginary arrow for the formation of the electrostatic latent image on the photosensitive member. Thereafter, the electrostatic latent image is developed into a visible image by the developing and cleaning device 4, and thus, the toner image corresponding to the original document is formed on the photosensitive member. The transfer paper fed into the transfer zone by the pair of feeding rollers 11 through the transfer paper transporting path 10 in synchronization with the appearance of the toner image on the photosensitive member is caused to closely adhere to the photosensitive member around the drum 1 at the transfer zone. In the above state, an electrical charge is imparted to the back of the transfer paper by the transfer corona charge 5, and the toner image on the photosensitive member is transferred onto the transfer paper, with subsequent separation of the transfer paper from the drum 1 by the pair of separating rollers 12. By the series of processes as described above, the image corresponding to the original is obtained on the transfer paper.

After the transfer process, for facilitating removal of the toner remaining on the surface of the photosensitive member of the drum 1, light rays are projected onto the photosensitive member surface by the charge eraser lamp 6, by which light projection, the residual charge remaining on the photosensitive member is removed. The removal of the above residual charge further facilitates removal of the toner by the developing and cleaning device 4 in the second rotation of the drum 1. In such second rotation of the drum 1, the corona discharger 3 for charging is at rest, while on the other hand, the developing and cleaning device 4 functions to remove the toner remaining on the photosensitive member. In the manner as described above, one copying cycle is completed through two revolutions of the drum 1.

According to the invention, the charge eraser lamp 6 has spectral characteristics free from emitting ultraviolet or near ultraviolet rays. Therefore, the deterioration on the surface of the photosensitive member composed of photoconductive organic material can advantageously be suppressed. It is to be noted here that the charge eraser lamp 6 is intended to remove the residual charge on the photosensitive member surface and does not have for its object to achieve recovery from or prevent the conventionally known fatigue phenomenon.

It should also be noted that the invention may be effected even when the cylindrical drum 1 described as employed in the foregoing embodiment is replaced by an endless belt-like element having a photosensitive member at least at one portion hereof which is known to those skilled in the art. It should further be noted that, for the photosensitive member as described in the foregoing, any photosensitive member may be employed so far as at least its surface is composed of photoconductive organic material.

The hereinbelow Examples are provided for the purpose of illustrating the invention without any intention of limiting the scope thereof.

EXAMPLE 1

A mixed solution composed of 10 parts by weight of poly-N-vinylcarbazole, 20 parts by weight of 2.4.7-trintiro-9-fluorenon, 5 parts by weight of acrylic resin (LR-018 made by Mitsubishi Rayon Company Limited, Japan), 5 parts by weight of benzene and 30 parts by weight of tetrahydrofuran was subjected to sufficient dispersion by an ultrasonic dispersing apparatus for the preparation of a coating solution. A 12-nylon layer of 4$\mu$ thickness was formed on an aluminum sheet on an aluminum sheet of 80μ thickness as a bonding layer, onto which the coating solution was subsequently applied by a wire-bar, with the thickness thereof after drying being made to 10μ, and thus, a photosensitive member was prepared.

In the next step, the photosensitive member thus prepared was mounted on the drum 1 of the copying apparatus shown in the drawing. Furthermore, by employing as the charge eraser lamp 6, a fluorescent lamp Matsushita Yellow-Coloured FL10Y-F/33T25 (name used in trade) having characteristics such that light rays with wave lengths shorter than 4500 Å were cut off, copying cycles with negative charging-exposure-developing-negative charge transfer-charge erasing-cleaning as one process were effected by the use of polarizable electrically conductive or semi-conductive toner for the experiments of repeated working characteristics thereof. As a result, superior copying characteristics sufficient for more than 60,000 copying operations could be achieved, and no large difference was noticed in the image quality even at the 60,000th copy as compared with that in the first copy, with beautiful copied images clear and definite in contrast and excellent in resolution being obtained.

COMPARITIVE EXPERIMENT 1

Experiments on repetition characteristics were carried out in a manner similar to that of Example 1 by the use of a similar photosensitive member, copying apparatus and appliances except that an ordinary white fluorescent lamp available under the name of FL 10W neolumi super white by Mitsubishi Electric Corporation and having light rays of wavelengths in the ultraviolet ray range was emplyed as the charge eraser lamp 6. As a result, by the use of the electrically conductive or semi-conductive toner, marked deterioration in the image density was noticed at the copying of 1,000th sheet, with difficulties in the identification even of copied characters.

EXAMPLE 2

A mixed solution composed of 3 parts by weight of β-type metal-free phthalocyanine, 2 parts by weight of 2.4.7-trinitro-9-fluorenon, 20 parts by weight of acrylic resin (LR-188 made by Mitsubishi Rayon) and 30 parts by weight of toluene was subjected to sufficient dispersion by an ultrasonic dispersing apparatus for the preparation of a coating solution. A 6-nylon layer of 3μ thickness was formed on an aluminum sheet of 80μ thickness as a bonding layer, onto which the coating solution was subsequently applied by a wire-bar, with the thickness thereof being made to be 8μ, and thus a photosensitive plate was prepared.

In the next step, the photosensitive member thus prepared was mounted on the drum 1 of the copying apparatus shown in the drawing. Furthermore, by employing the same fluorescent lamp as used in the Example 1, i.e. Matsushita Yellow-Coloured FL10Y-F/33T25 (name used in trade) having characteristics in which light rays with wavelengths shorter than 4500 A were cut off, for the charge eraser lamp 6, copying cycles with positive charging-exposure-developing-positive charge transfer-charge erasing-cleaning as one process were effected by the use of polarizable electrically conductive or semi-conductive toner for the experiments of repeated working characteristics thereof. As a result, superior copying characteristics sufficient for more than 30,000 copying operations could be achieved, and no large difference was noticed in the image quality even at the 30,000th copy as compared with that in the first copy, with beautiful copied images clear and definite in contrast and excellent in resolution being obtained.

COMPARATIVE EXPERIMENT 2

Experiments on repetition characteristics were carried out in a manner similar to that of Example 2 by the use of a similar photosensitive member, copying apparatus and appliances except that a fluorescent lamp FL10W neo-lumisuper white (trade name) made by Mitsubishi Electric Corporation and having light rays of wavelengths in the ultraviolet ray range was employed as the charge eraser lamp 6. As a result, maked reduction in the image density was noticed at the copying of the 1,000th sheet, with resultant extremely indefinite image quality of the copies.

According to a further aspect of the invention, a charge eraser lamp emits rays including ultraviolet rays and/or near ultraviolet rays, and an optical filter for absorbing ultraviolet rays and near ultraviolet rays is provided between the lamp and the photosensitive member.

Althrough the invention has been described and illustrated in detail, it is to be clearly understood that the same is by way of illustration and example only and is not to be taken by way of limitation, the spirit and scope of the invention being limited only by terms of the appended claims.

What is claimed is:

1. A transfer type electrostatic copying apparatus comprising:

a photosensitive member made of a photoconductive organic material substantially composed of 10 parts by weight of poly-N-vinylcarbazole, 20 parts by weight of 2.4.7-trinitro-9-fluorenon, 5 parts by weight of acrylic resin, 5 parts by weight of benzene and 30 parts by weight of tetrahydrofuran;

charging means for forming an electric charge on the surface of said photosensitive member;

exposure means for directing a light image of an original to be copied onto said charged photosensitive surface and for thereby forming an electrostatic latent image thereon;

developing means for forming a visible toner image of said electrostatic latent image by means of one-component polarizable toner particles;

transfer means for transferring said visible toner image onto a transfer paper; and charge eraser means for removing from said photosensitive surface any residual electric charge remaining thereon after transfer therefrom of said visible toner image by irradiating said photosensitive surface with light rays of wave lengths excluding ultraviolet rays and near ultraviolet rays.

2. A transfer type electrostatic copying apparatus comprising:

a photosensitive member made of a photoconductive organic material substantially composed of 3 parts by weight of β-type metal-free phthalocyanine, 2 parts by weight of 2.4.7-trinitro-9-fluorenon, 20 parts by weight of acrylic resin and 30 parts by weight of toluene;

charging means for forming an electric charge on the surface of said photosensitive member;

exposure means for directing a light image of an original to be copied onto said charged photosensitive surface and for thereby forming an electrostatic latent image thereon;

developing means for forming a visible toner image of said electrostatic latent image by means of one-component polarizable toner particles;

transfer means for transferring said visible toner image onto a transfer paper; and charge eraser means for removing from said photosensitive surface any residual electric charge remaining thereon after transfer therefrom of said visible toner image by irradiating said photosensitive surface with light rays of wave lengths excluding ultraviolet rays and near ultraviolet rays.

3. An apparatus as claimed in claims 1 or 2, wherein said charge eraser means comprises a lamp.

4. An apparatus as claimed in claims 1 or 2, wherein said charge eraser means comprises a lamp and optical filter means for absorbing ultraviolet rays and near ultraviolet rays.

* * * * *